United States Patent [19]

Dougherty et al.

[11] 4,225,536

[45] Sep. 30, 1980

[54] POWER VALVE

[75] Inventors: Michael Dougherty, East Detroit; Russell J. Wakeman, Novi, both of Mich.

[73] Assignee: Colt Industries Operating Corp., New York, N.Y.

[21] Appl. No.: 25,353

[22] Filed: Mar. 30, 1979

[51] Int. Cl.[2] ..... F02M 7/20

[52] U.S. Cl. ..... 261/69 R

[58] Field of Search ..... 261/69 R, 71

[56] References Cited

U.S. PATENT DOCUMENTS

| | | | |
|---|---|---|---|
| 2,361,103 | 10/1944 | Issigonis | 261/DIG. 19 |
| 2,591,090 | 4/1952 | Newman | 261/69 A |
| 3,188,062 | 6/1965 | Reid et al. | 261/DIG. 19 |
| 3,469,825 | 9/1969 | Du Bois | 261/71 |
| 3,572,386 | 3/1971 | Sherwin | 261/69 A |
| 3,588,058 | 6/1971 | Lucas | 261/69 A |
| 3,618,907 | 11/1971 | Severn | 261/DIG. 19 |
| 3,933,951 | 1/1976 | Fischer et al. | 261/121 B |

FOREIGN PATENT DOCUMENTS

| | | | |
|---|---|---|---|
| 2370866 | 6/1978 | France | 261/69 A |

*Primary Examiner*—Tim R. Miles

*Attorney, Agent, or Firm*—Walter Potoroka, Sr.

[57] ABSTRACT

A power valve assembly for use in combination with a carburetor for an internal combustion engine, where such carburetor has structure defining a fuel reservoir, is shown as having a valve body and cooperating valve member effective for opening and closing related passage means leading to the carburetor induction passage for at times supplying additional enrichening fuel flow thereto; a pressure responsive movable diaphragm has an associated actuator connected thereto and is exposed to a source of engine vacuum of varying magnitude as to at times move the valve member in a direction causing the valve member to move relative to the valve body and permit the flow of such enrichening fuel flow; the direction of movement of the diaphragm and associated actuator describing a path which is other than parallel to the path described by the direction of movement of the valve member.

9 Claims, 2 Drawing Figures

POWER VALVE

FIELD OF INVENTION

This invention relates generally to fuel metering apparatus and more particularly to fuel valving means often referred to as power valve assemblies employable as in carburetors for at times supplying an increased volume rate of fuel flow to the associated engine.

BACKGROUND OF THE INVENTION

Heretofore it has been accepted practice to provide, in carburetor structures, a power fuel enrichment system comprised of a power valve assembly carried by the carburetor in a manner so as to be effected by engine manifold vacuum. The manifold vacuum acting on a moveable pressure responsive member, which is adapted for operative engagement with the valving means of the power valve assembly, at idle or normal load conditions, as well as during engine deceleration, is strong enough to overcome a spring resistance so as to maintain the valving means closed. When high power demands place a greater load on the engine and manifold vacuum drops below a predetermined value, the said spring overcomes the reduced vacuum thereby opening the valving means. Consequently, fuel flows through the open valve means and ultimately into the carburetor induction passage thereby enriching the otherwise normally-provided fuel air mixture. As engine demands are reduced manifold vacuum again increases. The increased vacuum acts on the pressure responsive member to finally overcome the resistance of the said spring thereby closing the valving means and shutting off the added supply of fuel which is no longer required.

Because of governmentally imposed limitations on engine exhaust emissions and also governmentally imposed requirements for minimizing fuel consumption, it has often become practically impossible to provide a power valve assembly in a configuration as heretofore proposed by the prior art. That is, in order to meet such governmentally imposed limitations and requirements it has become necessary to add, for example, many different controls, passages and related structure to the otherwise conventional carburetor and, in so doing, it often becomes the case that there is less than adequate space available for the installation of the associated power valve assembly including its motor portion. It has often been found that in attempting to employ prior art power valve assemblies in present-day carburetor assemblies, the lack of adequate space dictates an overall power valve assembly which may have performance characteristics less than totally desirable.

Accordingly, the invention as herein disclosed and claimed is primarily directed to the solution of the preceding as well as other related and attendant problems.

SUMMARY OF THE INVENTION

According to the invention, a power valve assembly comprises a spring biased contoured valving member resiliently normally held in a closed or minimum flow position, and pressure responsive diaphragm means acted upon by engine vacuum for normally preventing the spring from initiating movement of the contoured valving member in the opening or increasing-fuel-flow direction, the pressure responsive diaphragm means having a direction of movement which is other than parallel to the direction of movement of the contoured valving member.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
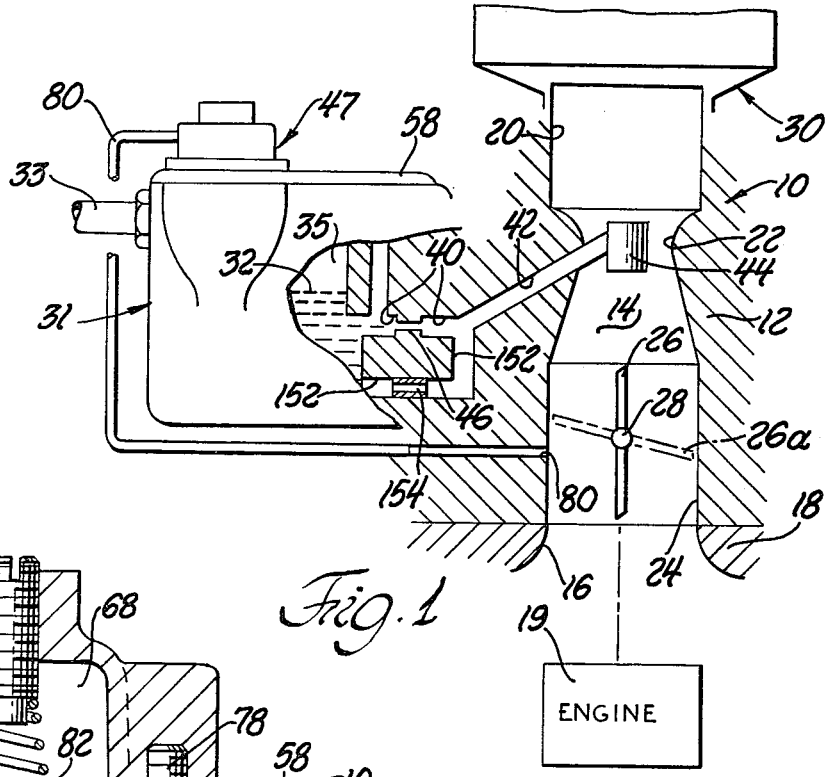
FIG. 1 is a somewhat diagrammatic view of a carburetor and the fuel system thereof showing, in elevation, a portion of a power valve assembly embodying teachings of the invention.

Referring now in greater detail to the drawings, FIG. 1 somewhat diagrammatically illustrates a carburetor 10 having a body 12 with an induction passage 14 formed therethrough communicating with a passageway 16 of an intake manifold 18, of an associated internal combustion engine 19, upon which the carburetor 10 is mounted. The induction passage 14 may be comprised of an air inlet 20, a main venturi 22 and a mixture outlet 24 in communication with manifold passageway 16. The flow through the induction passage 14 may be controlled by a throttle valve 26 mounted as on a throttle shaft 28 for pivotal rotation therewith so as to be variably positioned as by manual operation thereof. Usually, an air cleaner assembly, such as is indicated fragmentarily at 30, is operatively connected to the air inlet end 20.

Fuel may be supplied to the induction passage 14 as from fuel reservoir means 31 which in the example depicted may be the float or fuel chamber 35 of a fuel bowl having suitable float means and fuel inlet valving means (not shown but many of such being well known in the art) for controlling the admission of fuel 32 from a related supply and through inlet conduit means 33 into the interior 35 of reservoir means 31.

The fuel 32 flows from reservoir chamber 35 through a conduit 40 as to the main fuel nozzle 42 which discharges at the throat of the main venturi 22. A second or booster venturi 44 may be provided to form a discharge member for the main nozzle. A metering restriction 46 is provided in conduit means 40, as is the usual practice, and an idling fuel passage (not shown but well known in the art), of any suitable construction, may lead from conduit means 40 as to discharge adjacent the edge of the throttle valve 26 when in its closed position as shown in phantom lines at **26*a***. Suitable acceleration pump means, as well as check valves, vents and metering orifices may be provided, as is well known in the art.

Figure 2:
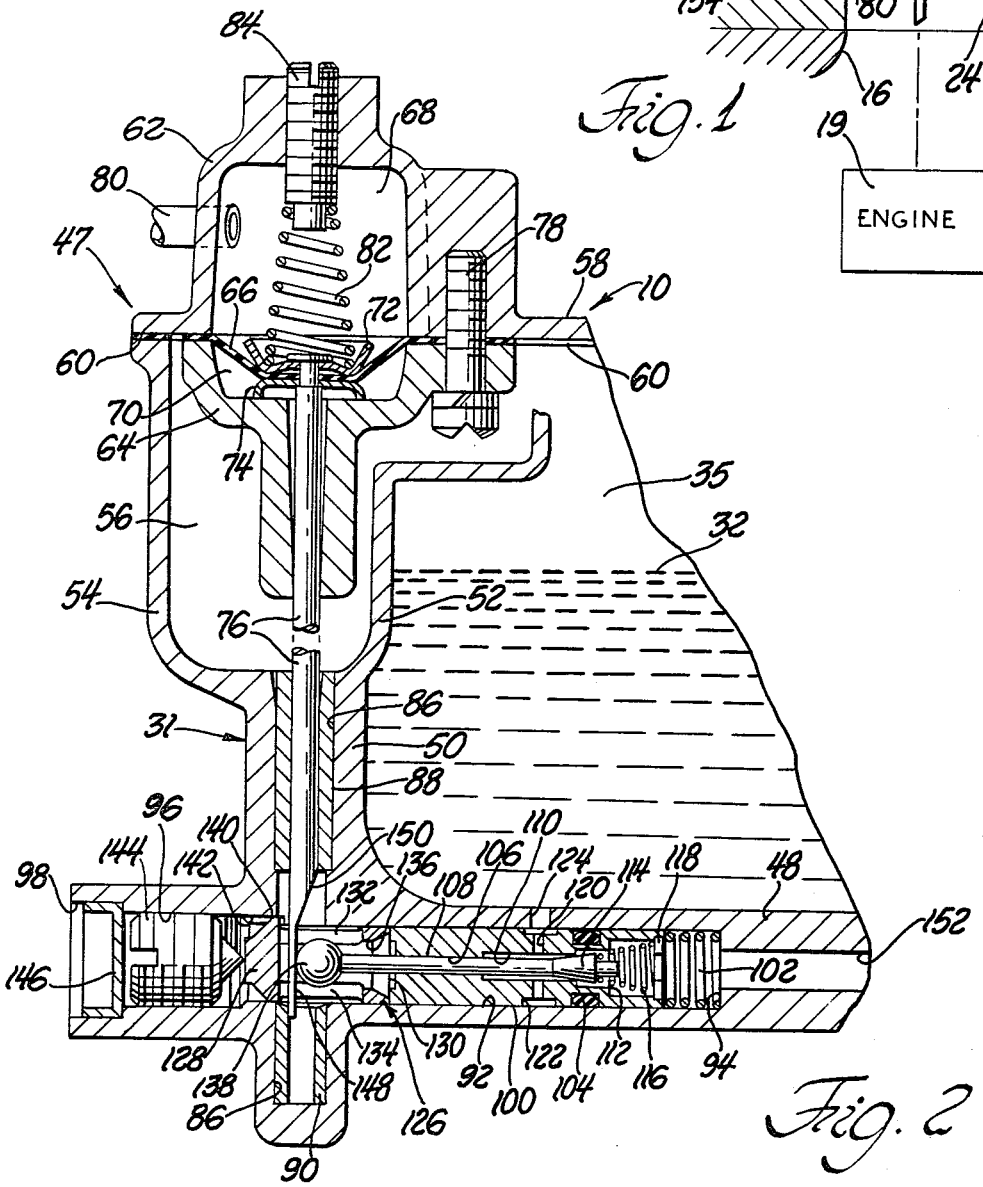
FIG. 2 is an enlarged fragmentary portion of the structure of FIG. 1 illustrating the power valve assembly in generally axial cross-section.

Referring in greater detail to FIG. 2, in the preferred embodiment, the fuel bowl or reservoir 31 is shown as comprising a lower disposed wall portion 48 and a generally vertically or upwardly extending wall portion 50 which, as generally depicted, may be further somewhat divided into inner and outer wall portions 52 and 54 defining a generally included space 56 which may accommodate a portion of the power valve assembly 47. The fuel bowl or reservoir assembly 31 is also shown as being provided with a cover portion 58 which may be secured to the remaining structure as by any suitable means. As depicted, a suitable seal or gasket 60 may be provided as between the cover and the upper peripherally juxtaposed portion of the wall means defining the chamber 35.

The cover 58 is provided with an upwardly extending housing portion 62 which cooperates with a lower disposed housing-like portion 64 in peripherally engaging and sealingly retaining a pressure responsive movable wall or diaphragm member 66 which, in cooperation with housing or body portions 62 and 64, defines opposite distinct and variable chambers 68 and 70. Oppositely disposed diaphragm backing plates 72 and 74 serve to operatively interconnect a motion transmitting member or actuator 76 to diaphragm 66. As generally illustrated, the lower housing or body portion 64 may be secured to upper housing portion 62 or cover means 58 as by a plurality of screws one of which is shown at 78. Chamber 70 is suitably vented as to ambient atmospheric pressure while chamber 68 is placed as in communication with a source of engine intake manifold vacuum as by conduit means 80 leading from chamber 68 to induction passage means 14 at a point downstrem of throttle valve 26. A coiled compression spring 82, situated in chamber 68, operatively engages the diaphragm 66 (as through backing plate 72) and is seated as against an adjustable spring seat or perch 84 which may be threadably engaged with housing portion 62 and provided with suitable sealing means as to preclude leakage through the threaded engagement.

A generally upwardly directed bore 86, formed as in wall portion 50, contains and retains an upper disposed guide or bushing-like member 88 and a lower aligned guide or bushing-like member 90. As will be discussed in further detail, bushings 88 and 90 serve to closely guide the stem or actuator 76 which, preferably, is cylindrical in configuration. Bore or passage 86 is, in turn, intersected by a second bore or passage 92 which, at one end, terminates as in an axial end face 94 and at its other end is provided with an internally threaded portion 96 opening to the ambient as through a counterbore 98.

A generally cylindrical valve body 100 is closely received within bore 92 and resiliently urged to the left (as viewed in FIG. 2) by spring means 102 engaging the end of valve body 100 and bore end face 94. Preferably, valve body 100 is provided with an annular recess or groove for the partial reception therein of related annular seal means 104 which serves to prevent flow therepast, in the axial direction, generally between valve body 100 and bore 92.

An axially extending passage 106 formed in valve body 100 closely receives an axially elongated valving member 108 axially reciprocatingly movable therein. An enlarged axially extending passage 110 terminates as in a valve orifice 112 with which valve surface 114 cooperates in determining the effective flow area therebetween. A coiled compression spring 116, seated as against a C-clip 118, carried by valve body 100, operatively engages the end of valve member 108 as to normally urge valve member 108 to the left (as viewed in FIG. 2) thereby bringing valve surface 114 into operative engagement with valve orifice surface 112. A plurality of generally radially extending passages or conduits 120 formed in valve body 100 serve to complete communication as between axially extending passage 110 and an annular groove or recess 122 formed in the outer surface of valve body 100. A conduit or aperture means 124, formed in lower wall 48, serves to complete communication as between the fuel 32 in chamber 35 and annulus 122.

Axially to the left (as viewed in FIG. 2) of valve body 100 and in abutting engagement therewith is a cup-like retainer 126 having a closed head-like end 128 and an open end 130 with diametrally opposed longitudinally extending slots 132 and 134 formed in the generally tubular wall of the retainer 126. The inner diameter 136 of the retainer 126 is such as to permit the free reception therein of a motion transmitting ball 138. Head portion 128 of retainer 126 is preferably provided with an integrally formed key portion 140 which is slidably closely received within cooperating keyway or slot 142. An adjustment screw 144 threadably engaged with threaded portion 96 is effective for axially adjusting the positions of retainer 126 and valve body 100 as against the resilient resistance of spring 102. Once such axial adjustment is made, access to the entire bore 92 may be sealingly closed as by suitable cup-like sealing means 146.

As depicted, in the preferred embodiment, the lower portion of stem or actuator 76 is provided with a surface 148 which is substantially parallel to the axis of movement of stem 76. Surface 148, in turn, blends into or intersects with a second relatively skew surface 150.

Either or both surfaces 148 and 150 may be flat, in transverse cross-section, or contoured to, for example, be complementary to the contour of ball 138. Further, skew or ramp-like surface 150 may be selectively contoured as to present a flat profile, as depicted in FIG. 2, or any other profile resulting in a particular incremental movement of ball 138 for a related particular incremental axial movement of stem actuator 76 when such surface 150 is in operative engagement with ball 138.

A conduit 152 communicating with the right end (as viewed in FIG. 2) of bore 92 preferably contains metering restriction means 154 (FIG. 1) and communicates at its other end as with the main nozzle 42 at a point downstream of main fuel metering restriction means 46.

OPERATION OF INVENTION

Generally, it is well known in the art that the value of manifold vacuum generated by the engine 19 will vary depending on such factors as engine speed, road load, and throttle valve position. For example, with the engine operating at idle, a relatively high value of manifold vacuum will be generated because, at such time, the throttle valve 26 is in its nominally closed position illustrated in phantom line at **26*a*. During such time, as is well known in the art, the principal means for supplying fuel to the induction passage 14 and intake manifold 16** is by suitable conduitry and metering means collectively referred to as the idle fuel system. Such idle fuel systems are well known in the art, and, for purposes of clarity, are not illustrated herein since the practice of the invention is not in any way limited to or by an associated idle fuel system. During such idle engine operation the manifold vacuum may be of a value in the order of, for example, 16.0 to 19.0 inches of mercury (Hg).

As the vehicle is started into motion by the movement of the throttle valve 26 (in the clockwise direction as viewed in FIG. 1) in the opening direction, the load placed on the engine increases and because of the throttle valve 26 being moved toward a more fully opened position the value of the manifold vacuum decreases. The amount of decrease will depend on the load placed on the engine as well as the rapidity with which the throttle valve 26 is rotated from its nominally closed position toward a more fully opened position. If the engine load is sufficiently great and the opening movement of the throttle valve is sufficiently rapid, the manifold vacuum may, during this time, decrease to a value in the order of, for example, 1.0 to 4.0 inches of Hg.

Further, when the vehicle is decelerating with the throttle valve nominally closed and the vehicle effectively driving the engine, the value of the generated manifold vacuum may substantially exceed that established at idle engine operation and be in the order of 21.0 to 22.0 inches of Hg.

Accordingly, it can be seen that manifold or engine generated vacuum is related to engine operation and as such may be employed as not only an actuating force but also a control parameter for related devices. Further, it can be seen that diaphragm 66 (FIG. 2) will be exposed to manifold vacuum of a varying value, depending upon throttle position and engine load, by virtue of the communication established by conduit 80.

The main fuel system, for example comprising restriction 46, conduit 40 and main nozzle 42, serves to supply fuel to the induction passage 14 generally during normal off idle engine operation, as is well known in the art. Further, the manifold vacuum acting on diaphragm 66 at conditions of idle, normal load conditions or deceleration is sufficient to overcome the force of spring 82 thereby moving the diaphragm 66 and stem or actuator 76 to their uppermost positions (the bottom segment of stem 76 is depicted in such a condition). However, when demands for higher or increased power place a greater load on the engine 19 and manifold vacuum decreases below a predetermined value, spring 82 overcomes the pressure differential across diaphragm 66 and moves the diaphragm and stem 76 downwardly to their lowermost positions (diaphragm 66 and upper segment of actuator stem 76 being shown in such a downward most position).

Without considering the action of the stem 76 on the ball 138 and valve member 108, it can be seen that when valve member 108 is moved to the right valve surface 114 moves away from cooperating valve orifice 112 thereby defining an effective flow area therebetween. When this happens, fuel 32, in fuel chamber 35, flows through passage means 124, into annulus 122, through passages 120, into passage 110, through the said effective flow area between orifice or valve seat 112 and valve surface 114, and into conduit 152 from where it flows as through restriction means 154 and into nozzle means 42 ultimately being discharged into induction passage means 14. The rate of fuel flow from the fuel bowl chamber or reservoir 31 to main well or nozzle means 42 thusly being increased by the opening of power valve member 108 causes an enrichment of the weight-rate of fuel flow through the main discharge nozzle 42 resulting in, of course, the ultimate enrichment of the fuel-air mixture being supplied to the induction passage 14 and intake manifold passageway 16.

When spring 116 is permitted to return valve member 108 to the closed position depicted in FIG. 2, the effective flow area between valve seat or orifice 112 and valve surface 114 is closed off thereby terminating the flow of additional fuel therethrough. This results in the rate of fuel flow being again controlled primarily by the effects of restriction 46.

As should at least be generally apparent, the movement of the valve member 108 to the right (opening direction) is achieved by the action of stem or actuator 76 while the movement of the valve member 108 to the left (closing direction) is attained by the action of the return spring 116.

Whenever the force of spring 82 is sufficient to overcome the opposing force of the pressure differential across diaphragm 66 (as when the magnitude of the manifold or intake vacuum is reduced as previously discussed) actuator or stem means 76 is moved downwardly (the generally lower portion thereof passing through the opposed clearance slots 132 and 134 of retainer 126). The initial portion of such downward movement may result in no displacement of ball 138 if the ball 138 is in contact with surface 148 of actuator 76. However, when actuator means 76 has moved downwardly a sufficient distance, ramp or actuating surface 150 engages ball 138 and, with further downward movement of actuator 76, causes ball 138 to be progressively displaced to the right (as viewed in FIG. 2). As ball 138 is thusly displaced, and because of it being juxtaposed to the end of valve member 108, valve member 108 is also moved to the right causing the opening of the effective flow area between valve seat or orifice 112 and valve surface 114 resulting in fuel flow therethrough as previously discussed. During such movement of stem or actuator 76 bushing means 88 and 90 serve to provide reinforcement and lateral stability to the stem 76 with such support or stability actually being provided at opposite points or sides of where the reaction force (reaction from ball 138) is applied to the stem 76.

In assembling the valve body 100 and other related elements into bore 92, it can be seen that the relative position of stem 76 (laterally) will be and is determined by the bushings 88 and 90 and that the ball 138 will have its left-most position determined as by the surface 148. Therefore, if it is found that with valve member 108 when against ball 138, and ball 138 being against surface 148, undesirable flow is occurring between orifice 112 and valve surface 114, such undesirable flow can be eliminated by rotating adjustment member 144 to thereby axially move retainer 126 to the right which, in turn, causes corresponding movement of valve body 100 to the right. Such adjustment movement would continue, while valve member 108 would remain against ball 138 by the resilient force of spring 116, until, because of the resulting relative movement, valve surface 114 becomes seated against valve orifice or seat 112 thereby terminating the undesirable flow.

The invention provides an arrangement whereby the power valve assembly motor means, as for example comprised of chambers 68, 70, diaphragm 66, spring 82 and actuator 76, can be physically situated at any convenient attitude with respect to the related valve body 100 and valve member 108 thereby enabling the physical arrangement thereof in any available space within an associated carburetor structure.

Further, the invention has been disclosed as employed in an overall carburetor structure 10 wherein a single main fuel discharge nozzle 42 feeds a single induction passage. It should be made clear that it is contemplated that the invention may be employed in multi-induction passage carburetors. For example, in a dual induction passage carburetor, dual main fuel discharge nozzle or the like may be provided and dual conduit means 152 may be provided with such dual conduit means respectively communicating with the illustrated end of bore 92. Further, in an arrangement wherein such two or more conduits 152 (or equivalent branches)

are employed, it is contemplated that restriction means as 154 would be in each of such conduits 152 (or in each of the equivalent branches) and that such plurality of restriction means 154 may or may not have the same metering characteristics or values since the desired rate of fuel enrichment to one of a plurality of induction passage means may be different from that of the other of such plurality of induction passage means.

Although only a preferred embodiment of the invention has been disclosed and described, it is apparent that other embodiments and modifications of the invention are possible within the scope of the appended claims.

What is claimed is:

1. A power valve assembly for use in combination with carburetor means for an internal combustion engine, said power valve assembly comprising power valve body means, a power valving member movable relative to said power valve body means, said power valving member and said power valve body means cooperating to define therebetween flow orifice means of variable effective area, pressure responsive movable diaphragm means, and actuator means operatively connected to and movable with said diaphragm means and effective to at least at times operatively engage said power valving member in order to thereby move said power valving member in a direction as to open said flow orifice means, said diaphragm means being exposed to a source of engine vacuum as to thereby be urged in a first direction, adjustable spring means normally urging said diaphragm means in a second direction opposite to said first direction, said actuator means being effective to move said power valving member in said direction to open said flow orifice means when said diaphragm means and said actuator means move in said second direction, and wherein said first direction and second direction define a path of movement other than parallel to the path of movement by said power valving member when said power valving member moves in said direction to open said flow orifice means, said carburetor means comprising fuel reservoir means, said fuel reservoir means comprising a lower disposed generally laterally extending wall portion and an upwardly extending wall portion, said pressure responsive diaphragm and actuator means and said power valve body and valving member are carried entirely by said wall portions.

2. A power valve assembly according to claim 1, wherein the engagement of said actuator means and said power valving member is through motion transmitting ball means.

3. A power valve assembly for use in combination with carburetor means for an internal combustion engine, said power valve assembly comprising power valve body means, a power valving member movable relative to said power valve body means, said power valving member and said power valve body means cooperating to define therebetween flow orifice means of variable effective area, pressure responsive movable diaphragm means, and actuator means operatively connected to and movable with said diaphragm means and effective to at least at times operatively engage said power valving member in order to thereby move said power valving member in a direction as to open said flow orifice means, said diaphragm means being exposed to a source of engine vacuum as to thereby be urged in a first direction, first spring means normally urging said diaphragm means in a second direction opposite to said first direction, said actuator means being effective to move said power valving member in said direction to open said flow orifice means when said diaphragm means and said actuator means move in said second direction, said first direction and second direction defining a path of movement other than parallel to the path of movement by said power valving member when said power valving member moves in said direction to open said flow orifice means, said carburetor means comprising fuel reservoir means, said fuel reservoir means comprising a lower disposed generally laterally extending wall portion and an upwardly extending wall portion, said pressure responsive diaphragm means and said actuator means being at least partly carried by said upwardly extending wall portion, said power valve body means and said power valving member being at least partly carried by said lower disposed wall portion, first passage means formed in said upwardly extending wall portion, second passage means formed in said lower disposed wall portion in a manner as to intersect said first passage means, first bushing means carried in said first passage means and situated as to be at one side of where said first and second passages intersect, second bushing means carried in said first passage means and situated as to be at an other side of where said first and second passages intersect, and said actuator means comprising a stem-like member guidingly received by said first and second bushing means.

4. A power valve assembly according to claim 3 wherein said valve body means comprises a generally cylindrical body having a third passage formed therein for the slidable reception of said valving member, a fourth passage formed in said cylindrical body, a valve seat carried by said cylindrical body, said fourth passage means communicating with said valve seat, and fifth passage means formed in said cylindrical body communicating between said fourth passage means and fuel within said fuel reservoir means.

5. A power valve assembly according to claim 4 wherein second spring means is carried by said valve body means and resiliently urges said valving member toward said valve seat.

6. A power valve assembly according to claim 5 wherein said second spring means operatively engages and resiliently urges said valve body means and said valving member in a direction toward said stem-like member.

7. A power valve assembly according to claim 6 and further comprising generally tubular retainer means carried in said second passage means and situated as to be generally at the intersection of said first and second passage means, first and second clearance openings formed in said retainer means for receiving said stem-like member therethrough, and a motion transmitting member situated in said retainer and engagable by said stem-like member, and wherein said stem-like member comprises actuating surface means effective for engaging and actuating said motion transmitting member, said motion transmitting member being effective to engage and move said valving member as to open said flow orifice means when engaged and actuated by said actuating surface means.

8. A power valve assembly according to claim 7 and further comprising keying means, said keying means being effective to maintain said retainer means in a position as to assure alignment of said first and second clearance apertures with said first passage means.

9. A power valve assembly according to claim 8 and further comprising adjustment means, said adjustment means being operatively engaged with said retainer means and effective to selectively axially adjust said retainer means and said valve body means.

* * * * *